US005515608A

United States Patent [19]

Zhang

[11] Patent Number: 5,515,608

[45] Date of Patent: May 14, 1996

[54] POWERED SHAVER CLEANER

[76] Inventor: Yuhua Zhang, 925 11 Ave., Greenley, Colo. 80631

[21] Appl. No.: 410,505

[22] Filed: Mar. 24, 1995

[51] Int. Cl.[6] ..... B26B 19/48

[52] U.S. Cl. ..... 30/41; 30/41.6

[58] Field of Search ..... 30/41, 41.6; 15/179, 15/183, 218, 250.22

[56] References Cited

U.S. PATENT DOCUMENTS

| | | | |
|---|---|---|---|
| 2,184,645 | 12/1939 | Key | 30/41 X |
| 3,421,216 | 1/1969 | Anna | 30/41.6 X |
| 4,899,442 | 2/1990 | Horii et al. | 30/41 |

*Primary Examiner*—Douglas D. Watts

[57] ABSTRACT

A new improved cleaning apparatus is provided for all powered-shaver to replace their hand-used brushes for the cutting blade compartment and the cover cleaning. It works quickly, thoroughly and securely, as well as contributes to good health maintenance.

11 Claims, 2 Drawing Sheets

POWERED SHAVER CLEANER

FIELD OF THE INVENTION

This invention relates to all powered shavers for their cleaning apparatus.

BACKGROUND-PRIOR ART

There are three kinds of shavers currently used all over the world: 1) single rotary head, which is popular in Japan and China; 2) triple rotary head, like Norelco in the U.S.A.; 3) single or double foil shaver, like BrAun and Remington in the United State. There is only one type of hand-used brush being used for cleaning the hair particles in the hair-collection compartment, no matter what type of the shaver. Some of them, such as U.S. Pat. No. 3,949,472, the blades themselves are utilized for the function of vacuuming the hair particles sticking onto the blades; and U.S. Pat. No. 4,054,963 comprises a housing having an air duct to vacuuming the hair particles. However, the hair-collection container still need to be cleaned by the hand-used brush after several times. In another U.S. Pat. No. 5,083,336, a plate-like main member of sweeping brush is used for the cleaning the hair particles, it is limited to a certain type of shaver and it is still a hand-used tool. Every time people clean the residue with brush, they would sweep back and forth, it takes time to get rid of the entire residue, otherwise some people just take off the metal cover and drop part of the residue by shaking and tapping the blade container. Unfortunately, it is not sufficiently clean after this procedure. The remaining residue could be blown out of the cover during the next time use, and it is also dangerous if some particles would be inhaled into their breathing passages.

The purpose of the present invention is to provide an automatic shaver cleaner, which enables people to clean up the cutter blade compartment and get rid of the shaving particles in seconds.

SUMMARY OF THE INVENTION

The object of this invention is to provide an automatic shaver cleaner to replace the hand brushes used now for all powered shavers. The invention consists of the cleaning unit which is a set of brushes, inserted into the blade container of the shaver after removing the shaving unit and using the electric power of the shaver to automatically clean the interior of the hair-collection compartment.

The advantage of the invention is that it works faster and more efficiently by using electric power by the application of a set of brushes which increase the amount of area covered. In addition, it is simpler construction and less costly.

BRIEF DESCRIPTION OF THE DRAWINGS

The present invention will be more fully understood by referring to the following detailed description when read in conjunction with the attached drawings.

DETAILED DESCRIPTION OF THE INVENTION

Figure 1:
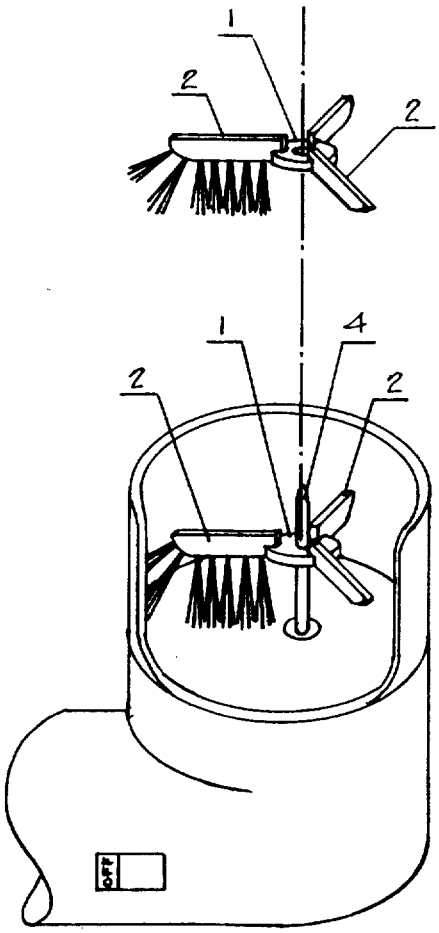
FIG. 1 is an explosion and partly assembled view of major components of the single rotary head shaver cleaning device.
Figure 2:
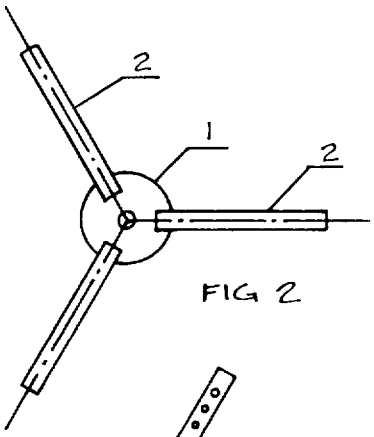
FIG. 2 is a top view of the single rotary head shaver cleaning device.
Figure 3:
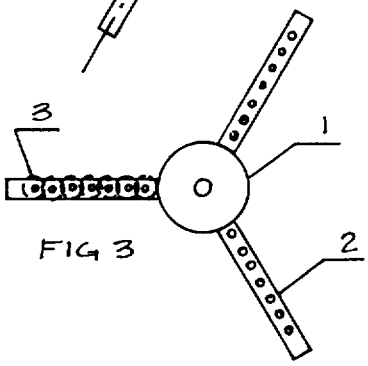
FIG. 3 is a underneath view of the single rotary head shaver cleaning device.
Figure 4:
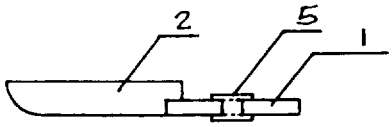
FIG. 4 is a side view of the single rotary head shaver cleaning device.

The cleaning apparatus for the single head shavers shown in FIG. 1–FIG. 4 includes a hub connector 1, on which three brush holders 2 are mounted, and sets of brushes 3 are staggered on the holders. The coverage of the brushes is increased and fulfilled, so the shaving particles all over the container would be wiped out. The hub connector 1 is intended to clamp onto the working shaft 4 by means of an I-shaped rubber gasket 5 which allows the cleaning unit to be raised or lowered on the shaft 4 for proper cleaning.

Figure 5:
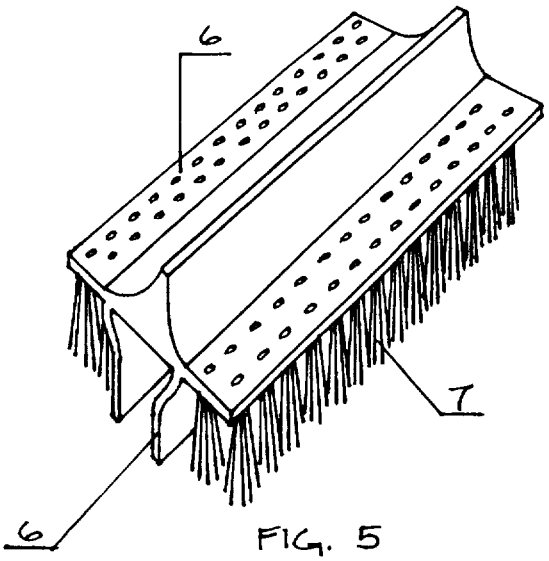
FIG. 5 is a perspective view of the single foil shaver cleaning device.

The cleaning device for single foil shaver consists of a clamping bar 6 in FIG. 5 which fits onto the oscillating shaft. The bar holds a set of staggered brushes 7 on each side of the bar 6 which oscillates in a motion of back and forth to clean the interior of the blade container.

Figure 6:
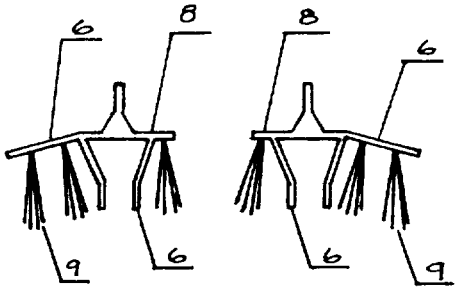
FIG. 6 is a side view of the double foil shaver cleaning device.
Figure 7:
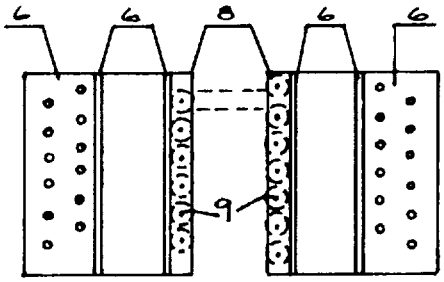
FIG. 7 is the underneath view of double foil shaver cleaning device.

The two mirror imaged clamping rectangular bars 6 in FIG. 6 and FIG. 7 are used for the double foil head shaver. The narrow side of brush holder 8 of each bar facing each other when installed onto the oscillating shafts. Sets of bristles 9 are mounted on the holders.

Figure 8:
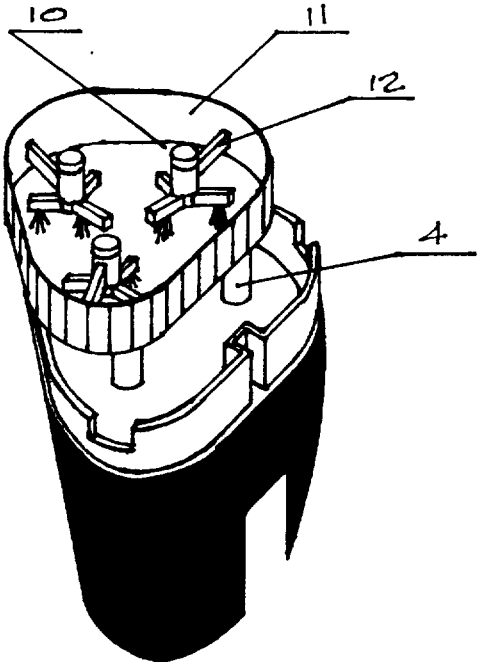
FIG. 8 is an explosion view of the triple rotary head shaver cleaning device.
Figure 9:
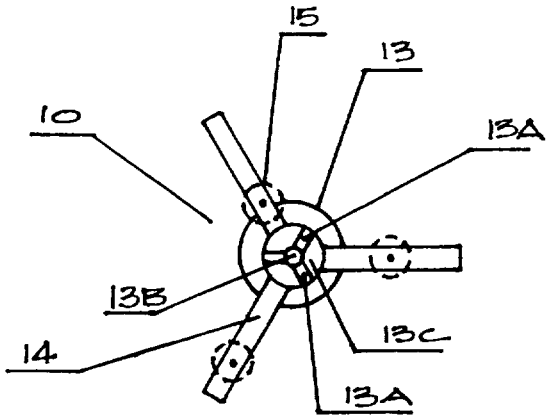
FIG. 9 is the underneath view of partly triple rotary head cleaning device.
Figure 10:
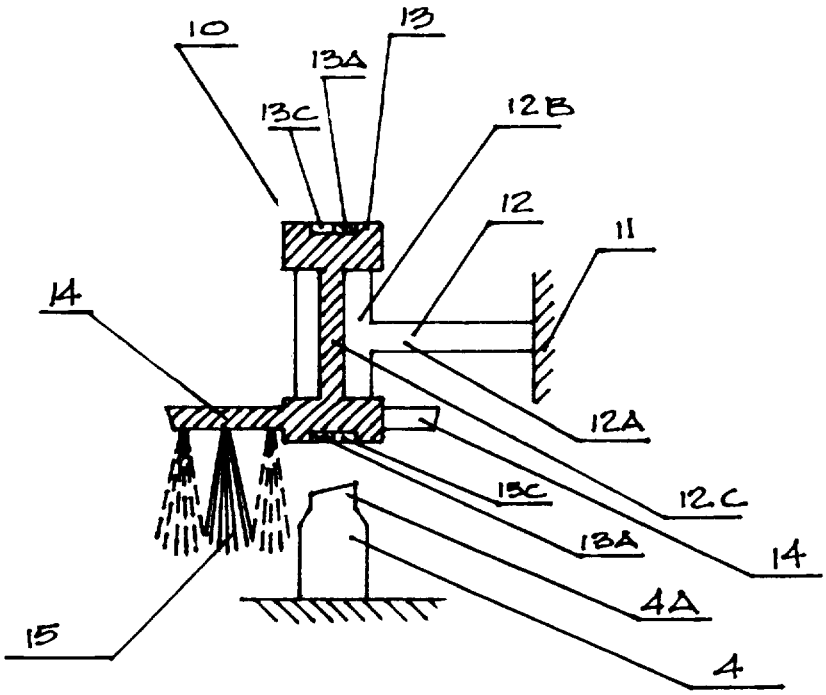
FIG. 10 is a partly sectional view of triple rotary head shaver cleaning device.

The triple rotary head shavers cleaning device in consists of three sets of cleaning subunits 10 shown in FIG. 8–FIG. 10 which are held by a triangle frame 11. There is a T-shaped connector 12 between the cleaning subunits 10 and the frame 11. In FIGS. 10 the I-shaped coupling member 13 goes into T-shaped connector 12. Three bristle holders 14 in FIG. 9 and FIG. 10 are on the bottom of the I-shaped coupling member 13, and one set of bristle 15 is staggered on each holder.

OPERATION

Each time before cleaning, you should take off the foil screen and the cutter blade, then put the cleaning unit onto the working shaft. In operating the cleaning device, the sets of brushes will spin or vibrate quickly from the electric power and will clean the hair-collection compartment thoroughly, completely, and quickly in seconds. In addition, by flipping the hub connector 1 or the triangle frame 11, the cleaning device can be used for cleaning the plastic cover.

What is claimed is:

1. A powered cleaning device for a power-driven shaver having a compartment for a cutting blade means powered by a power unit with the compartment having interior surfaces on which hair and debris collect as a result of the operation of the cutting blade means, said cleaning device comprising:

mounting means adapted to fit in said compartment and coupled to and driven by said power unit, a cleaning head carried by said mounting means including outwardly extending brushes to engage and sweep against said interior surfaces, said mounting means, cleaning head and brushes being disposed in said compartment in the space normally occupied by said cutting blade means after said cutting blade has been removed, whereby upon actuation of said power unit the brushes sweep the interior surface of said compartment to dislodge hair and debris.

2. A device as set forth in claim 1 wherein said mounting means includes a hub connector in the form of a flexible hub with an aperture and said power unit having a shaft on which said hub is slidably movable and frictionally held.

3. A device as set forth in claim 1 wherein said mounting means includes a clamping bar adapted to snap fit on an oscillating shaft of a vibrating type single foil razor.

4. A device as set forth in claim 1 wherein said mounting means includes a triangular frame sized to fit within and conform to a triangular compartment for a cutting blade.

5. A device as set forth in claim 1 wherein said brushes are supported on a brush holder and there are three circumferentially spaced of said brush holders at 120 degree intervals.

6. A device as set forth in claim 3 wherein said clamping bar has two sets of staggered brushes along each side.

7. A device as set forth in claim 1 wherein said mounting means includes two spaced mirror image clamping bars adapted to snap fit on a pair of oscillating shafts of a vibrating type double foil shaver, each of said clamping bars having a wide side brush holder and a narrow side brush holder, there being two sets of staggered brushes on said wide side and one set of brushes on said narrow side.

8. A device as set forth in claim 4 wherein said mounting means and cleaning head includes a plurality of circumferentially spaced cleaning head assemblies in said compartment, each said cleaning head assembly including a T-shaped connector having an arm portion connected to said frame and extending inwardly and an end portion with an aperture, an I-shaped coupling member in said aperture, said coupling member spins freely in said end portion, and circumferentially spaced brush holders extending radially out from said coupling member, there being a plurality of brushes extending out from each of said brush holders.

9. A device as set forth in claim 8 wherein said coupling member has a top side and a bottom side, each of said sides having spokes radiating from and interconnected by a central hub portion with coupling apertures between said spokes to form sockets to receive and connect with a spindle of the powered shaft razor power unit.

10. A device as set forth in claim 8 wherein each said cleaning assembly has three circumferentially spaced brush holders at 120 degree intervals and a set of brushes on each of said holders.

11. A device as set forth in claim 8 wherein said mounting means is inverted with said top coupling members becoming bottom coupling members and engaging associated spindles for having the brushes clean a cover for said compartment.

* * * * *